United States Patent [19]

Addison, Jr.

[11] Patent Number: 4,930,810

[45] Date of Patent: Jun. 5, 1990

[54] TIMING DEVICE FOR SKIERS

[76] Inventor: Oswald G. Addison, Jr., 6809 Nashville Rd., Lanham, Md. 20706

[21] Appl. No.: 326,114

[22] Filed: Mar. 20, 1989

[51] Int. Cl.[5] ..... A63C 11/22

[52] U.S. Cl. ..... 280/821; 200/332.2; 280/816; 368/10; 368/69; 368/284

[58] Field of Search ..... 280/821, 819, 816; 135/66; 368/10, 278, 69, 70, 284; 200/332.2, 333, 61.85

[56] References Cited

U.S. PATENT DOCUMENTS

| | | | |
|---|---|---|---|
| 4,082,302 | 4/1978 | Albrecht | 280/816 |
| 4,111,444 | 9/1978 | Clements, Jr. | 280/816 |
| 4,206,445 | 6/1980 | Steinhauer | 280/819 |
| 4,278,274 | 7/1981 | Ray | 280/821 |
| 4,731,766 | 3/1988 | Bunyea | 280/816 |
| 4,762,340 | 8/1988 | Addison, Jr. | 280/821 |

FOREIGN PATENT DOCUMENTS

| | | | |
|---|---|---|---|
| 352297 | 7/1931 | United Kingdom | 368/10 |

*Primary Examiner*—Charles A. Marmor
*Assistant Examiner*—Eric Culbreth
*Attorney, Agent, or Firm*—Millen, White & Zelano

[57] ABSTRACT

This invention consists of a ski pole with a handle on which a liquid crystal display (LCD) chronometer is detachably mounted. The chronometer is mounted inside the push button at the top of the ski pole handle and held in place by a lens and four set screws. The push button is located as to be actuable by the thumb of the skier.

5 Claims, 1 Drawing Sheet

TIMING DEVICE FOR SKIERS

BACKGROUND OF THE INVENTION

The present invention relates to a ski pole having a stopwatch incorporated therein, which the stopwatch is removably mounted in the handle of the ski pole.

A person using a conventional type stopwatch will be unable to measure his travel time accurately; the task would require simultaneously pushing off with the ski poles and actuating the stopwatch. It would be difficult, if not impossible, to attain this task. Checking the travel time of a downhill run or a cross country event would necessitate assistance. Obviously, the combination watch and stopwatch with a ski pole will make this feat possible by accurately giving the time of day and a time check of any segment of said events without assistance.

There are minor similarities between this present invention and a patent previously granted to this applicant U.S. (Pat. No.: 4,762,340).

SUMMARY OF THE INVENTION

According to the present invention there is provided a ski pole having a handle, in combination with a chronometer, the chronometer being detachably secured in the handle of the ski pole.

Preferably, the chronometer has a housing which is detachably connected to the handle by means of a lens and four set screws.

BRIEF DESCRIPTION OF THE DRAWING

An embodiment of the invention is described below by way of example, with reference to the accompanying drawing, in which.

DETAILED DESCRIPTION

Figure 1:
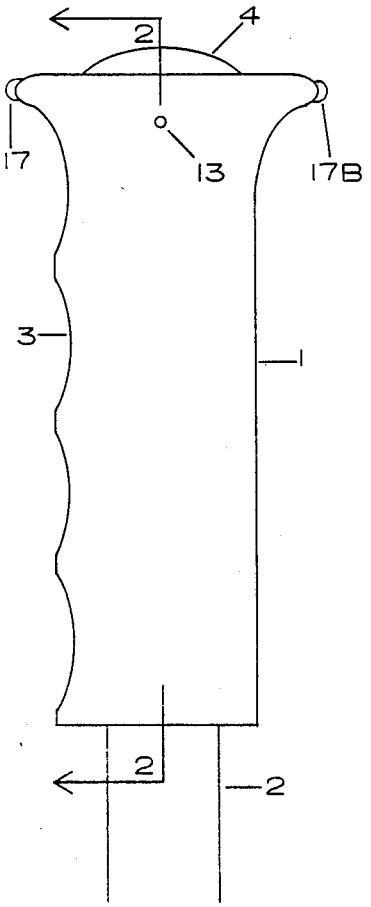
FIG. 1 shows the ski pole handle, push button, weep hole and function buttons.

FIG. 1 shows a handle 1 of a ski pole of which only a portion 2 is shown. The ski pole 2 handle 1 preferably has four finger grip portions 3, weep hole 13, function buttons 17 and 17B and the push button 4 which is so arranged that the stopwatch can be actuated by the thumb. In the present embodiment, the handle 1 is extruded from a plastic material composition.

Figure 2:
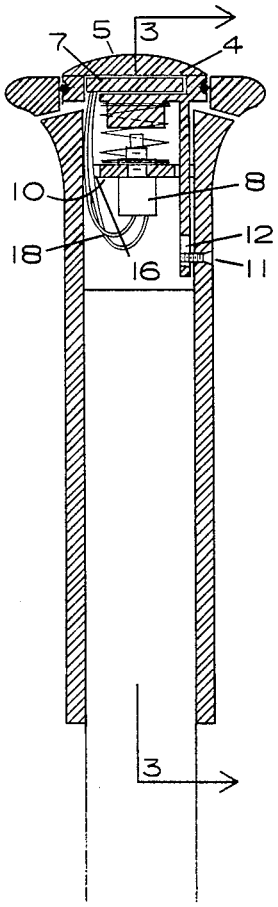
FIG. 2 shows a cross sectional view of FIG. 1, along line 2—2.

FIG. 2 is a cross sectional view of the ski pole 2 handle 1. The push button assembly 4 is actuated by the downward push of the thumb toward the land created by the drain ridge 15 in a direction which corresponds to the axis of the grip 1 and ski pole 2 which in turn depresses the button the electronic switch 8. The electronic switch 8 mounted on the o-ring 10 is an extension of the actuation member that controls a switch in the watch/stopwatch module 7 for the purpose of starting, stopping and resetting the timing function in a singular repeated operation. The watch/stopwatch module 7 is installed in the top section of the push button assembly 4 and held in place by a lens 5 and four set screws 6. The lens 5 is incorporated as part of the push button assembly 4. The push button assembly 4 is held in place by a retainer screw 11 which is inserted through the wall of the handle 1 and through the retainer slot 12 on the push button assembly 4. The access opening 16 in the o-ring 10 is provided for the electrical connecting wires 18 between the electronic switch 8 and the watch/stopwatch module 7. The LCD display face 19 will display either the stopwatch function, time of day, or temperature.

Figure 3:
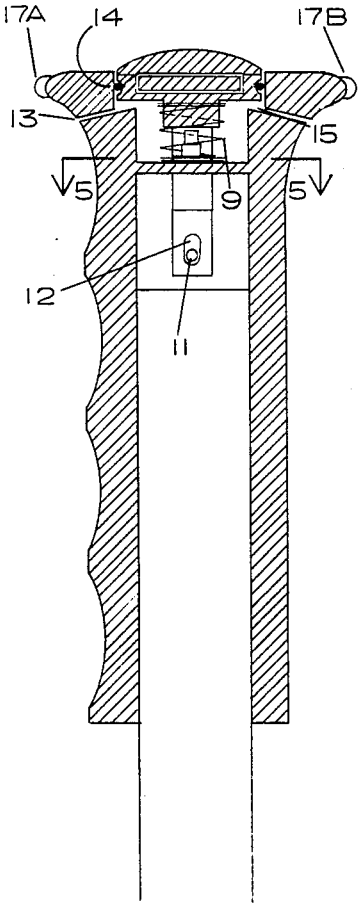
FIG. 3 shows a longitudinal section of FIG. 2 along line 3—3.

FIG. 3 is a longitudinal section of the handle 1 showing the function buttons 17A and 17B. The spring 9 that is mounted on the o-ring 10 moves the push button assembly 4 back to the start position after being depressed. The weep holes 13 that are positioned around the top portion of the handle 1 allow any water or moisture to drain off that may collect in the drain ridge 15 which could seep between the water resistant rubber gasket 14 and the push button 4.

Figure 4:
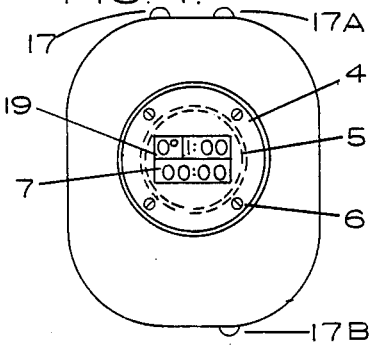
FIG. 4 shows a top view of the ski pole handle with the function buttons installed in its perimeter, LD face, lens and four set screws.
Figure 5:
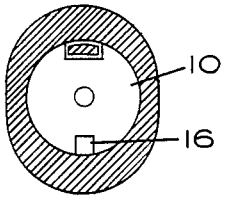
FIG. 5 shows a cross sectional view of the ski pole handle and o-ring in FIG. 5, along line 5—5.
Figure 6:
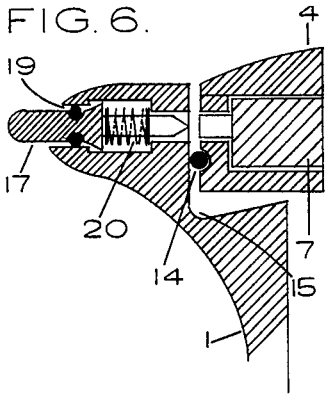
FIG. 6 shows a partial cross sectional enlargement of the ski pole handle, function button and the push button with the watch/stopwatch module inserted inside.

FIGS. 4 and 6 show the function buttons 17 and 17A that are installed in the top portion of the handle 1 which changes the function of the watch/stopwatch module 7 by depressinng the function button 17 or 17A which in turn depresses the button on the watch/stopwatch module 7 so that either time of day, stopwatch, or temperature is displayed on the face 19 of the watch-/watchstop module 7. FIG. 6 is a partial enlargement of the handle 1. The rubber gasket 19 prevents water from entering the handle 1. The spring 20 moves the function buttons 17, 17A, and 17B back to the start position after being depressed.

The above description shall not be construed as limiting the way in which this invention may be practiced but shall be inclusive of many other variations that do not depart from the broad interest and intent of the invention.

I claim:

1. A combination grip and timing device for a ski pole, the grip having an axis coextensive with the axis of the ski pole and having a free end; the combination comprising:

a recess within the free end of the grip, the recess having a land therein;

a timing display mounted in the recess for movement therein in an axial direction with respect to the axis of the grip toward and away from the land, the timing display being visible at the free end of the grip;

switch means operating the timing display and disposed within the grip inboard of the timing display for operation by the timing display upon movement of the timing display in the axial direction;

biasing means for biasing the timing display away from the switch means;

a plate within the grip, the plate having a first surface upon which the switch means is mounted facing the timing display with the biasing means disposed between the timing display and the first surface, and means for retaining the timing display within the grip recess.

2. The combination of claim 1, wherein the means for retaining the timing means in the display comprises a stem projecting down into the grip and being retained therein by a pin-in-slot connection.

3. The combination of claim 1, further including weep holes through the grip in alignment with the land.

4. The combination of claim 1, wherein the timing display is retained within a transparent casing having a convex lens portion which normally projects above the free end of the grip.

5. The combination of claim 1, further including openings in the grip adjacent to the timing display, wherein the timing display has lateral actuators and wherein the grip includes bores therein aligned with the lateral actuators and includes plungers in the bores for operating the actuators.

* * * * *